US005839999A

United States Patent [19]

Pflugner

[11] Patent Number: 5,839,999

[45] Date of Patent: Nov. 24, 1998

[54] CALF AND FOOT EXERCISE DEVICE

[76] Inventor: Kenneth A. Pflugner, 55131 Willowcreek Dr., Mishawaka, Ind. 46545

[21] Appl. No.: 822,663

[22] Filed: Mar. 24, 1997

[51] Int. Cl.[6] ..... A63B 21/02

[52] U.S. Cl. ..... 482/146; 482/125; 482/907

[58] Field of Search ..... 482/140, 148, 482/907, 145, 121–130, 89

[56] References Cited

U.S. PATENT DOCUMENTS

| | | | |
|---|---|---|---|
| 650,656 | 5/1900 | Raabe . | |
| 1,194,884 | 8/1916 | Sandow . | |
| 1,706,654 | 3/1929 | Christesen | 482/125 |
| 1,734,238 | 11/1929 | Sweeney | 482/124 |
| 2,613,932 | 10/1952 | Manners | 482/124 |
| 5,122,107 | 6/1992 | Gardner | 482/140 |
| 5,207,627 | 5/1993 | Doran . | |
| 5,328,433 | 7/1994 | Berman . | |
| 5,476,435 | 12/1995 | Nimmo . | |
| 5,489,251 | 2/1996 | Robles, Jr . | |

FOREIGN PATENT DOCUMENTS

| | | | |
|---|---|---|---|
| 579583 | 1/1994 | European Pat. Off. | 482/121 |
| 0030562 | 1/1907 | Germany | 482/124 |

*Primary Examiner*—Jerome W. Donnelly
*Attorney, Agent, or Firm*—Baker & Daniels

[57] ABSTRACT

An exercise device having a first and second foot stirrup securable around the feet of a user, a flexible padded belt having a first and second end securable around the lower back of a user while in the sitting position on a floor. A first collapsible linkage connected between first end of flexible belt and first foot stirrup. A second collapsible linkage connected between second end of flexible belt and second foot stirrup. A first tension mechanism with a first and second end connected between first flexible belt end and first foot stirrup and a second tension mechanism with a first and second end connected between second flexible belt end and second foot stirrup. A first and second adjusting "S" hook connected between the first and second collapsible linkages to allow user to selectively position device to fit users body size. An adjustable locking cross member is provided to keep first and second collapsible linkage parallel to each other prevent foot stirrups thus users legs and feet from spreading apart.

3 Claims, 5 Drawing Sheets

CALF AND FOOT EXERCISE DEVICE

TECHNICAL FIELD

This invention relates to the art of exercise devices and, more directly to portable devices especially designed to increase calf muscle strength, in the leg, and strength in the arch of the users feet.

BACKGROUND:PRIOR ART

In today's world of competition, specifically athletic competition, it is desirable for people that choose to get involved and become competitive in such sports as basketball, baseball, volleyball, football, soccer, track and field, wrestling, figure skating, and others that require the use of ones legs and more specifically calf and foot strength. Therefore, it is an advantage to an athlete to be able to jump higher and endure longer than ones opponent to become a success. My invention helps athletes achieve this goal by providing a device specifically designed to isolate both calf muscles and foot arches at the same time when said device is in the exercise mode.

At the present time, the best known methods to strengthen calf muscles and foot arches are the prior art of barbells (free weights) whereby the user applies discs of weight to both ends of a metal bar and secures them in place with clamps, then placing the bar upon the users shoulders. In a standing position the user would raise up on the balls of his or her feet thus exercising the calf and arch with resistance from gravity of the free weights. This is a method that works however it has several disadvantages: 1) availability of use of a gym where the free weights are usually located and the hours in which the gym would be open to utilize such weights; 2) cost of buying a weight set, approximately four times the cost of my invention; 3) room to keep and store free weight equipment at home. It takes up room in one's basement, garage or bedroom that otherwise could be utilized for something else; 4) taking free weight with you when you travel, very inconvenient considering one would have to take at least 200 lbs. of weight with them to duplicate the resistance of my exercise device; 5) danger, in using free weights by oneself, the user would be wise to have someone to help get the weight upon the shoulders and watch that they don't fall or lose balance which can, and does occur, and; 6) strain of free weight on users back that can occur if proper technique is not used.

A prior art device, with disadvantages, is by Sherman V. Robles, Jr. U.S. Pat. No. 5,489,251 granted in February of 1996. His device exercises only one calf muscle at a time. Unless the user were to purchase two devices and adjust them equally to give both calves the same workout, my invention works both calf muscles and arches of the feet at the same time with equal resistance obtainable. Also, my invention adapts to different size users, for people that are a height of 5' to people that are up to 7'2". In studying the drawings and reading Robles U.S. Pat. No. 5,489,251, one cannot conclude the device adjusts to different height users. The last disadvantage discovered in U.S. Pat. No. 5,489,251 is that one could conclude that by securing wrapping member #22 around user's thigh with straps #38 that in order to be tight enough around the thigh to function, it could restrict some blood flow to the calf and foot muscles intended to be exercised, which is not desirable. My invention allows free blood flow to both lower legs and feet with no restriction by strapping members.

In citing another prior art on the subject of calf muscle development would be U.S. Pat. No. 3,739,500 known as the STRENGTH SHOE. Although this patent is not related in regard to embodiments as my invention, my invention has some distinct advantages over the STRENGTH SHOE. First, there is no impact to the user's legs, feet or body with my invention. The STRENGTH SHOE requires running and jumping with the device in place on one's feet, which does create impact. Also, when using the STRENGTH SHOE, the user needs ample room to work out, be it a road, a sidewalk, parking lot, or when the weather is inclement, a gym floor or other type of covered area. My invention can be used in a very limited space, anywhere in the home, motel or gym, all that is required is one vertical wall. Although the STRENGTH SHOE's principle is good, the user needs to exercise with caution when using it. Proper stretching and warm up are recommended by the manufacturer or injury can occur.

Another object of my invention is that it will fit any user from the height of 5' to 7'2", making it available for sharing by members of teams. All that is needed are two quick and easy adjustments to fit the different members. The STRENGTH SHOE U.S. Pat. No. 3,839,500 is fitted like regular shoes, one size does not fit all. The user must have his or her own pair to fit, at a cost much higher than my invention.

Another method of strengthening calf muscles and arches is the jump rope, a known method for years. Although portable, it too has disadvantages. The first, in order to use the rope indoors the user has to have high enough ceilings to be able to swing the rope over one's head with no obstructions to complete a 360 degree circle around the user's body. Like the STRENGTH SHOE, U.S. Pat. No. 3,739,500, it also creates impact to one's calves, feet and body which sometimes is not desirable to the athlete; therefore it would be desirable in a portable calf and foot exercising device to be easily carried and taken with a user on a trip, vacation, from room to room in the home and to the workout facility of one's team, to be shared by team members. It is also desirable to have a calf and foot arch exercising device that needs little room to operate, ease of operation and noise free when in the exercising mode, unlike a jump rope, free weights and platform shoes. It is further an object of the present invention to provide a new and improved portable device that is easily stored in a carrying bag, suitcase, or can be hung in the closet.

It is the object of the present invention to provide the user with a mental edge over his or her opponent knowing that strength in calf muscles and foot arches increases vertical height in one's jumping ability and that it is an advantage in most physical sports.

It is further object of the present invention to provide the user with a device that strengths calf and foot muscles without the impact training of other methods and devices (platform shoes, jumping rope, jumping from a low point to a high point).

It is further object of the present invention to provide a device that offers no impact to the user's calves, feet and body which may be desirable to the users due to the need for rehabilitation exercise, or other problems such as blisters or bruises or even back problems where the athlete cannot use the aforesaid methods.

It is still further object of the present invention to provide a device that fits virtually all athletes, big and small, with two quick and easy adjustments to one's size.

Still another object of the present invention is the versatility where the device is used. It can be used in one's bedroom, living room, motel room, family room, garage, office, gym or any room utilizing one with a vertical wall.

Still another object of the present invention is that one does not need weather conditions to dictate whether or not one can work out due to inclement weather conditions, for running, jumping rope and working out.

Still yet further object of the present invention is to provide a new and improved portable, lightweight, calf and foot exercising device that is low cost and maintenance free.

Still yet a further object of the present invention is the wear factor, virtually nonexistent. In my invention, due to construction of said device from industrial strength materials (belting) and zinc plated metal components to resist rust and corrosion. My device should last the athletic lifetime of the user.

Still another object of the present device is the ability of adjustment as the user grows in height. My invention will adapt to the user through his/her growing years, unlike special shoes and different length jump ropes.

It is still further object of the present invention to provide a device to exercise calf and foot arch muscles that does not require any restrictive strapping around any other muscles of the leg that in turn might restrict blood flow to the muscles intended to be exercised.

It is still a further object of my invention to provide a device that strengthens through exercising calf muscles of the legs and foot muscles of the arch in a way that delivers equal resistance to both calves and feet at the same time providing a balances workout.

Further objects and advantages of my invention will become apparent from consideration of the drawings and ensuing description of it.

SUMMARY DISCUSSION OF INVENTION

To achieve the foregoing and other advantages, the present invention, briefly described, provides a new and improved portable calf muscle and foot arch muscle exercising apparatus which includes a padded flexible belt which conforms around the user's lower back while in the sitting position on a floor, and the user's back resting flat against a vertical wall. The legs of the user are extended with feet at shoulders width apart, and knees in locked position so back of user's legs are in contact with the floor. The user's feet are inserted into the two foot stirrups. Each foot stirrup is connected to a counter force tension member which in turn is connected to a collapsible linkage which in turn is secured to the end of the flexible belt member by an adjusting "S" hook, with users toes pointed up in the air and back toward the user's head. The balls of the user's feet are in place in the foot stirrups and equal amounts of collapsible links are taken up with the use the "S" hooks. The counter force members and collapsible linkage are now in line with tension to created 180 degrees from foot stirrup through counter force tension member through the flexible belt, around lower back through "S" hook through collapsible linkage, through counter force tension members to the opposite foot stirrup. After initial adjustment is obtained the two collapsible linkages are hooked together by means of an adjustable cross member to prevent the stirrups and thus legs from spreading apart. Device is now in operating mode. The user now exerts down pressure with the balls of the feet thus creating pressure to the counter force tension members as the calves and arches of the feet are flexed and thus exercised. The more pressure that is applied, the more pressure is exerted on the calves and arches; the more repetitions, the greater the workout. User also can apply pressure and hold down for a set amount of time for an isometric workout. The opposite and equal pressure exerted by the user is absorbed by the user's bone structure from the feet through the legs to the lower back.

BRIEF DESCRIPTION OF DRAWINGS

The invention will be better understood and the above objects as well as objects other than those set forth above will become more apparent after a study of the following detailed drawings in which like elements are given the same or analogous reference numbers and wherein.

EXEMPLARY MODE FOR CARRYING OUT INVENTION AND DESCRIPTION OF PREFERRED EMBODIMENT

Figure 1:
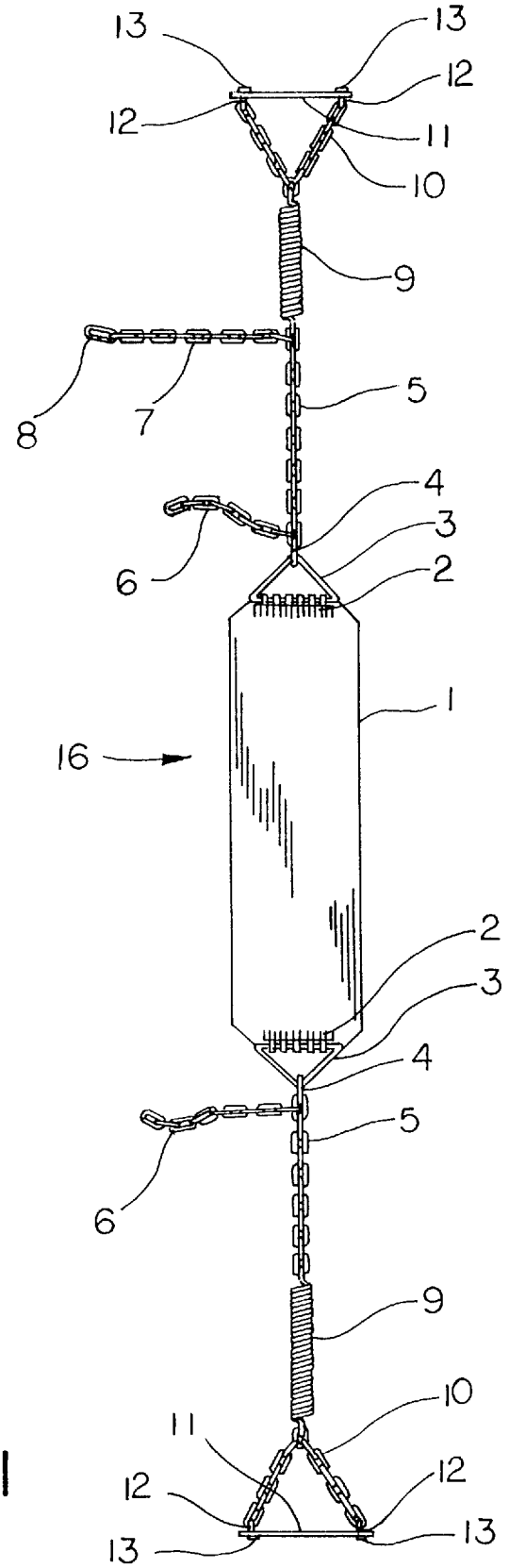
FIG. 1: Is a flat view of the preferred embodiment on a floor or table with all slack taken up in linkage of device.

With reference to the drawing, FIG. 1 is a view of the preferred embodiment of exercising device laying flat on a floor or table.

Figure 2:
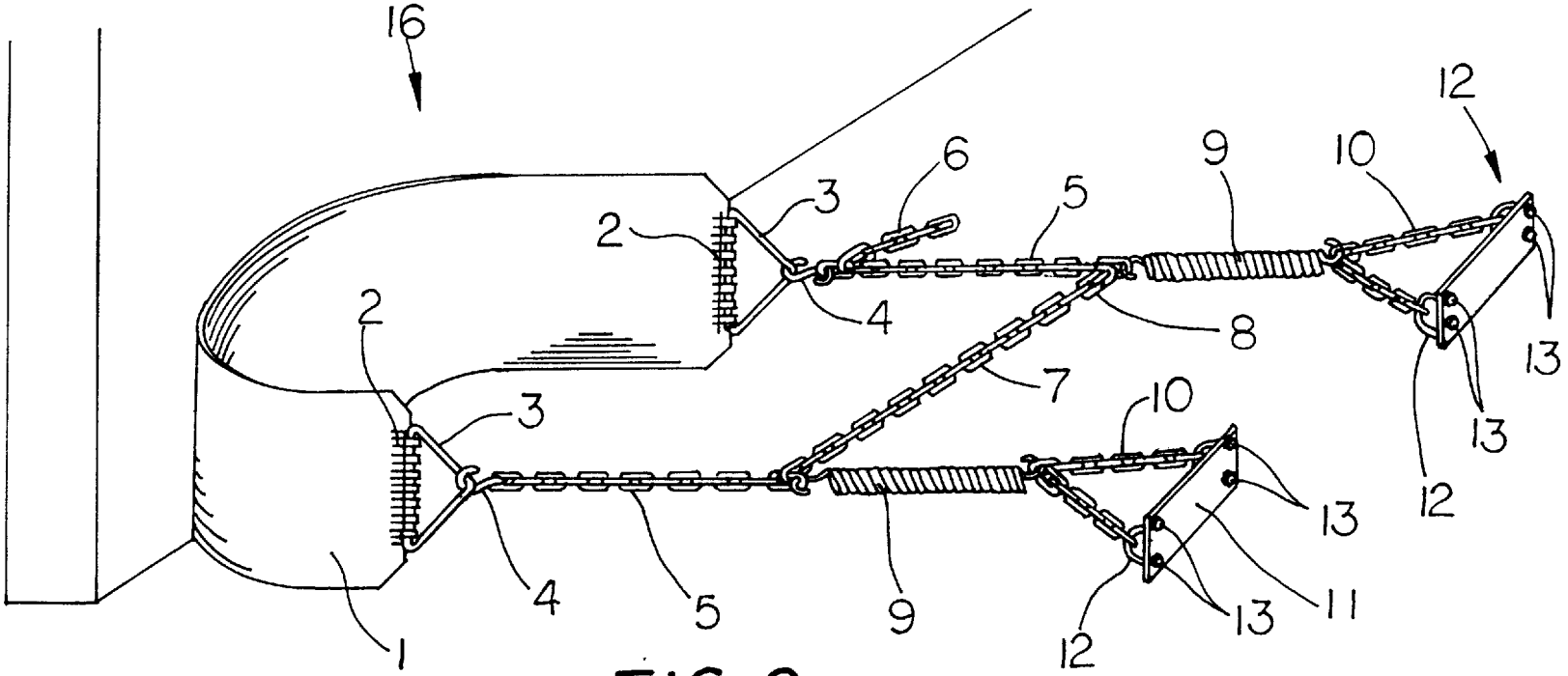
FIG. 2: Is a three dimensional view of preferred embodiment in the exercising mode with all slack taken out of flexible belt member and connecting linkage.
Figure 3:
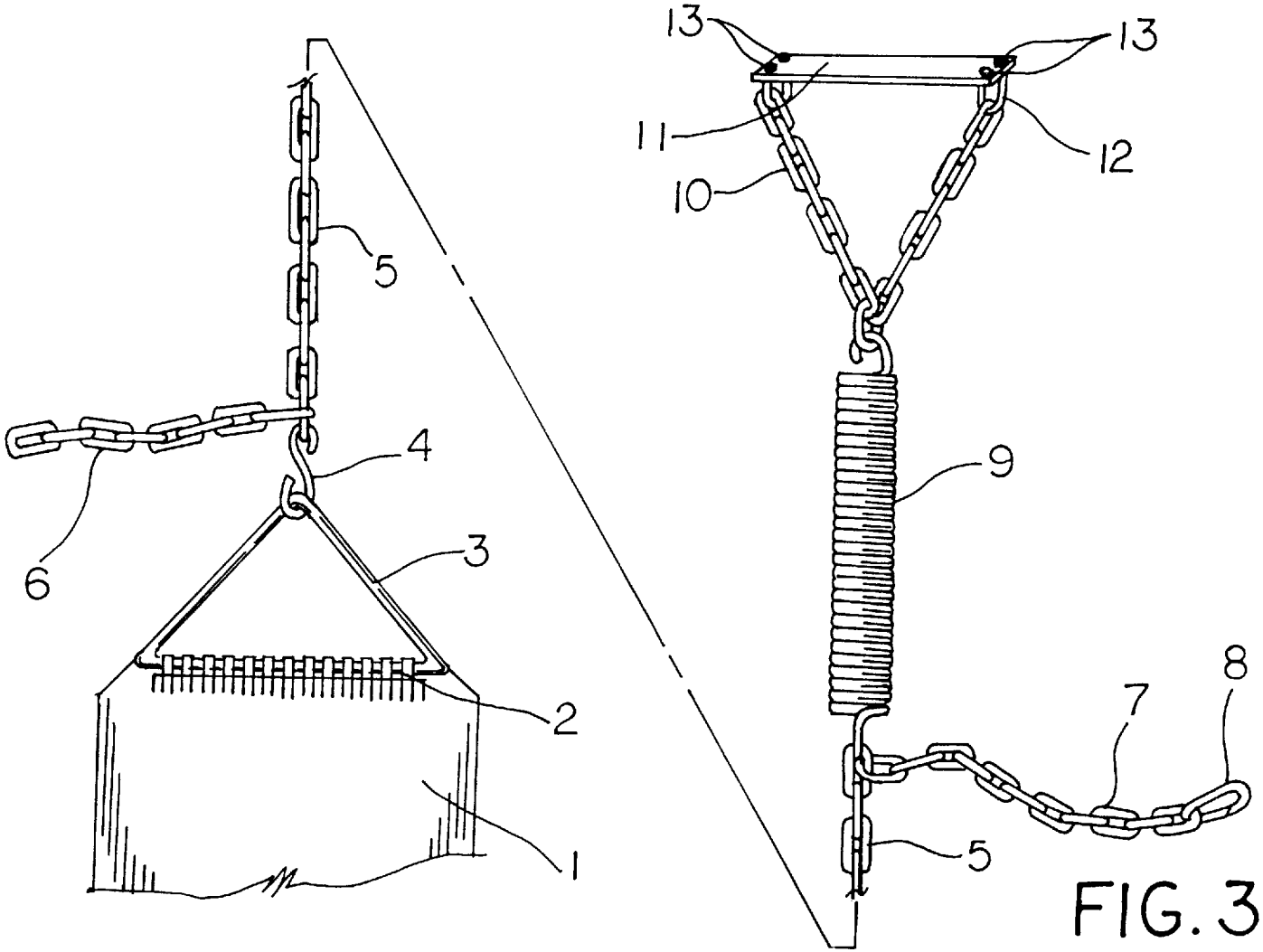
FIG. 3: Is an enlarged partial broken detail of half of the preferred embodiment of the belt, linkage, counter force tension member and stirrup.
Figure 4:
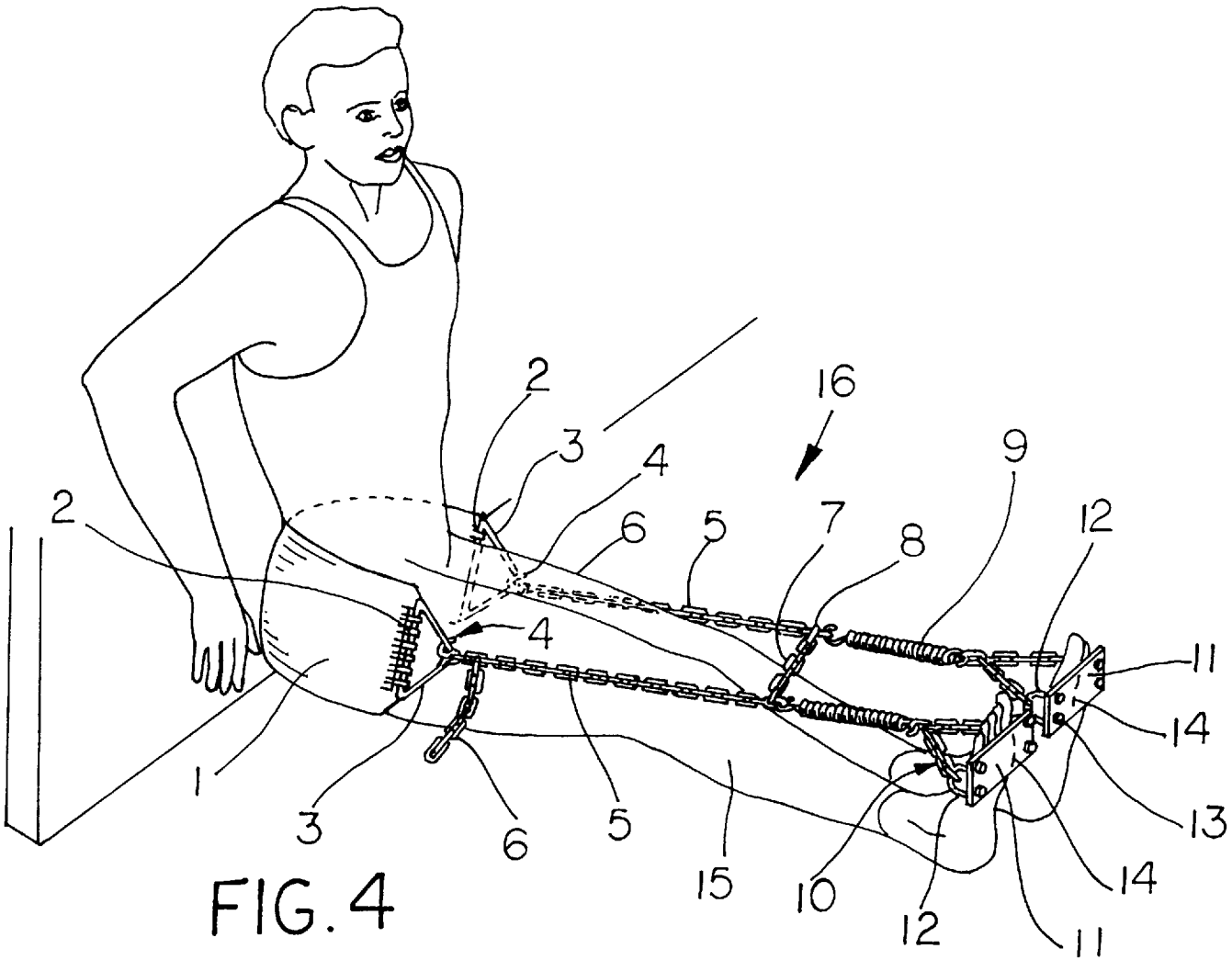
FIG. 4: Is a three dimensional view of exercising device in place on a user, and adjustment of linkage obtained.
Figure 5:
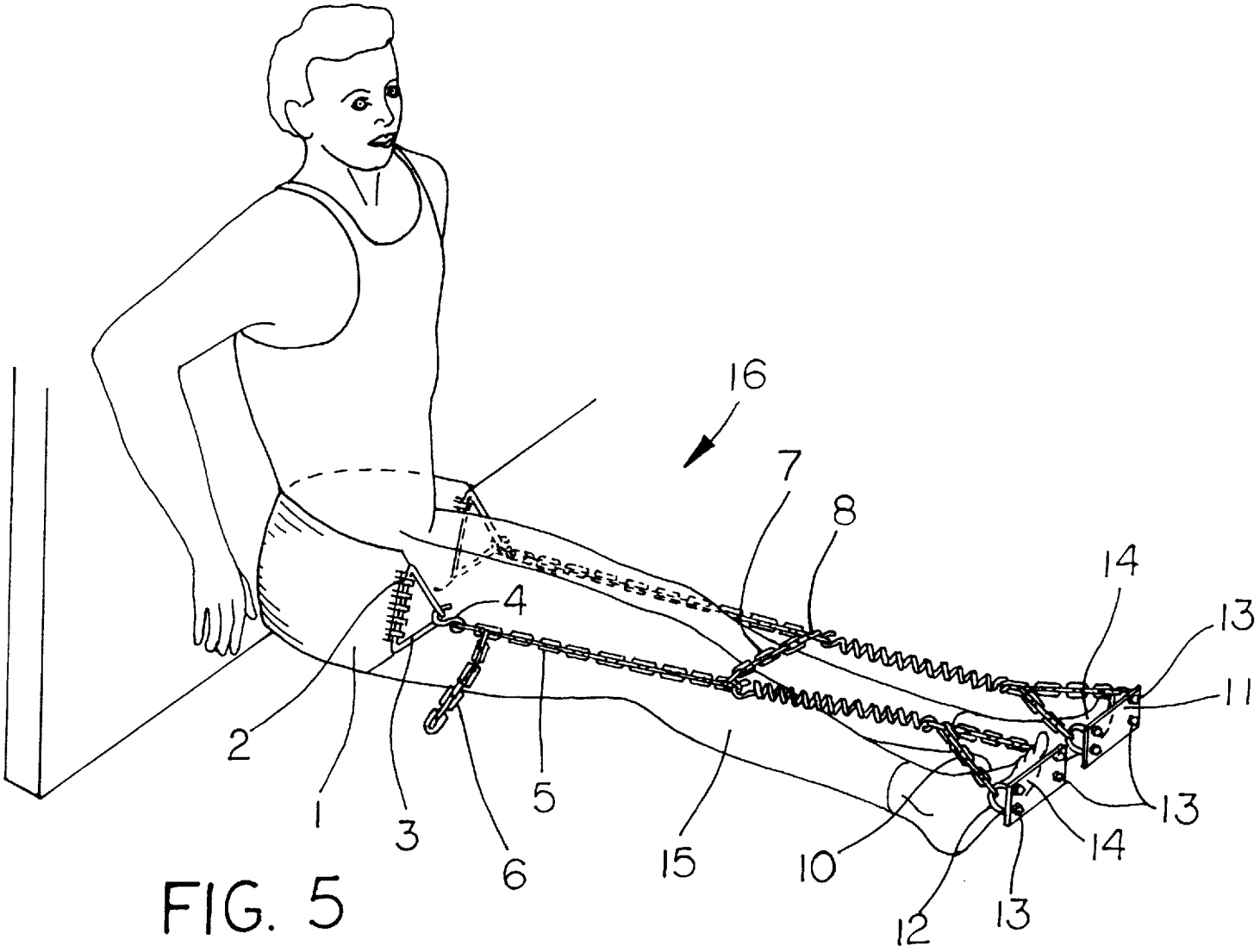
FIG. 5: Is three dimensional view of device with user in the exercise mode applying pressure into device with balls of feet with force from calf and foot muscles.

With reference to the drawing, FIG. 2, there is shown a first exemplary embodiment of the portable calf and foot arch exercising apparatus generally designated by reference numeral 16 in its preferred form. Calf and foot arch exercising apparatus 16 includes a flexible padded belt member 1 adapted to fit around the lower back of the user while in the sitting position on a floor and user's back resting against a vertical wall (FIG. 4). Starting at both ends of flexible belt member 1, detailed in FIG. 3, you find a preferred fastening method of metal triangle 3 secured by belt 1 by metal lacing 2. Also secured to triangle 3 at 180 degrees is adjusting "S" hook member 4 closed together or welded to triangle 3. "S" hook 4 is opened on opposite ends and slipped through the preferred link in chain linkage 5 as to get the proper pre-tension adjustments to the particular user. At one end of chain 5 counter force tension spring 9 is permanently attached by means of a closed eye. At the opposite end of counter force tension spring 9 a similar closed eye exists which in turn is connected to the center link of stirrup chain 10, thus having equal links of chain continuing onto the stirrup flat foot bar 11. The connection means of stirrup chain 10 and flat bar 11 is preferred to be a "U" bolt 12 intersecting the last link on each end of chain 10 and through two holes in flat foot bar 11 and secured in place by threaded nut member 13. Referring to FIG. 4, after device is in place by user with user's back against a vertical wall and legs extended with feet at shoulder width apart, user's knees are locked so that the backs of user's legs are in contact with the floor and with user's toes are pointed up and back toward the head. Adjustment for using device is now obtained by taking up all slack in linkage 5 by means of slipping adjusting "S" hook 4 into the proper link on linkage 5. Foot stirrup flat bar 11 is to be in place on users balls of feet at this time. After this is achieved, both linkage members 5 are hooked together in the parallel position by means of cross member 7 and snap hook 8 to prevent user's legs from spreading apart while device is in the operating mode. Cross member 7 is attached to the same common intersection of linkage 5 and counter force tension spring 9 and is 90 degrees to linkage 5 and hooked with snap hook 8 into opposite common intersection of linkage 5 and counter force tension spring 9. Referring specifically to FIG. 5, the device is now in the exercise mode. As user exerts pressure with balls of feet 14, and calf muscles 15 on device, the counter force tension springs 9 extend, thus exercising feet and calf muscles 15 simultaneously. The counter force of the tension springs 9 is absorbed in the users body, more specifically, the bone structure of the users body, from the lower back through the pelvis, thigh bone, the locked knee joints through the shin bones, through the ankle bones to the feet.

It can be seem from the preceding description that a calf and foot arch exercising device which provides equal and balances resistance to both calf and foot arch muscles with no impact and no restriction to leg blood flow has been provided.

It is noted that the embodiment of the exercising device described here in detail for exemplary purposes is of course subject to many different variations in structure, design, application, and methodology. Because many varying and different embodiments maybe made within the scope of the inventive concept(s) herein taught and because many modifications maybe made in the embodiment herein detailed in accordance with the descriptive requirements of the law, it is to be understood that the details herein are to be interpreted as illustrative and not in a limiting sense.

What is claimed is:

1. A new and improved calf and foot arch exercising device comprising: a flexible belt having a first end and a second end, positionable around the lower back of the user and subjected to tension; a first stirrup securable around the first foot of said user by said tension; and a second foot stirrup securable around the second foot of said user by said tension; a first resilient counter-force tension mechanism connected between said first foot stirrup and said first belt end; a second resilient counter-force tension mechanism connected between said second foot stirrup and said second belt end; a first substantially non-elastic collapsible linkage connected between said first foot stirrup and said first belt end; a second substantially non-elastic collapsible linkage connected between said second foot stirrup and said second belt end; a first adjusting open hook end connected between said first belt end and said first collapsible linkage; a second adjusting open hook end connected between said second belt end and said second collapsible linkage; and a cross member having links; said cross member having a first end secured to said first collapsible linkage at a point closer to said first foot stirrup than to said first belt end; said cross member having an adjustable second end formed by an open link selectively located on any link of said links in said cross member, thus becoming said adjustable second end; said open link hooked to said second collapsible linkage at a point 90 degrees to a corresponding location on said first collapsible linkage thereby hooking said first collapsible linkage and said second collapsible linkage together to prevent said foot stirrups from spreading apart while said device is in use.

2. The exercise device of claim 1 wherein said device as a whole is held in place on said user by said tension applied to the device between said user's lower back, legs and feet.

3. The exercise device of claim 1 wherein said belt is padded.

* * * * *